US008067140B2

(12) United States Patent
Sensui

(10) Patent No.: US 8,067,140 B2
(45) Date of Patent: Nov. 29, 2011

(54) TONER FOR DEVELOPING ELECTROSTATIC IMAGE AND METHOD OF PRODUCING THE SAME

(75) Inventor: Keita Sensui, Tokyo (JP)

(73) Assignee: Zeon Corporation, Tokyo (JP)

( * ) Notice: Subject to any disclaimer, the term of this patent is extended or adjusted under 35 U.S.C. 154(b) by 967 days.

(21) Appl. No.: 12/022,501

(22) Filed: Jan. 30, 2008

(65) Prior Publication Data

US 2008/0182189 A1 Jul. 31, 2008

(30) Foreign Application Priority Data

Jan. 31, 2007 (JP) ..... 2007-022493

(51) Int. Cl.
*G03G 9/08* (2006.01)

(52) U.S. Cl. ..... 430/108.2; 430/108.22; 430/137.15

(58) Field of Classification Search ..... 430/108.2, 430/10.22, 137.158, 108.22, 137.15
See application file for complete search history.

(56) References Cited

U.S. PATENT DOCUMENTS 6,887,637 B2 * 5/2005 Niwa ..... 430/108.22

FOREIGN PATENT DOCUMENTS

| | | | |
|---|---|---|---|
| JP | 11-15192 | A | 1/1999 |
| JP | 2000-3076 | A | 1/2000 |
| JP | 2000-321809 | A | 11/2000 |
| JP | 2001-117272 | A | 4/2001 |
| JP | 2006-184687 | A | 7/2006 |
| WO | 2005-081639 | A3 | 9/2005 |
| WO | 2005-091080 | A1 | 9/2005 |
| WO | 2007-010828 | A1 | 1/2007 |

OTHER PUBLICATIONS

Japanese Office Action dated Apr. 19, 2011, issued in corresponding Japanese Patent Application No. 2007-022493.

* cited by examiner

*Primary Examiner* — Mark Chapman
(74) *Attorney, Agent, or Firm* — Westerman, Hattori, Daniels & Adrian, LLP

(57) ABSTRACT

A toner for developing electrostatic image which has a reduced residual amount of a decomposed product of a polymerization initiator remaining in the toner upon production (mainly an ether component) and an unreacted polymerizable monomer (mainly styrene), less odor produced upon fixing so as to avoid deteriorating surrounding environment, an excellent shelf stability at high temperature upon storing or anti-blocking property, and an excellent printing durability under both N/N environment and H/H environment upon printing is provided. A toner for developing electrostatic image comprising a colored resin particle which is obtained by polymerizing a polymerizable monomer composition containing a polymerizable monomer, a colorant and a charge control resin in an aqueous dispersion medium in the presence of a polymerization initiator, wherein the charge control resin is a quaternary ammonium base containing copolymer having a glass transition temperature "Tg" in the range from 70 to 100° C.; the polymerization initiator is an organic peroxide; and each residual amount of an ether component and styrene remaining in the toner for developing electrostatic image is respectively less than 500 ppm and less than 50 ppm.

19 Claims, 1 Drawing Sheet

TONER FOR DEVELOPING ELECTROSTATIC IMAGE AND METHOD OF PRODUCING THE SAME

BACKGROUND OF THE INVENTION

1. Field of the Invention

The present invention relates to a toner for developing electrostatic image used for development of a latent image of electrostatics in an electrophotography, an electrostatic recording method, an electrostatic printing process or the like. Particularly, the present invention relates to a toner for developing electrostatic image which has less odor produced upon fixing so as to avoid deteriorating surrounding environment and excellent printing durability. Hereinafter, "a toner for developing electrostatic image" may be simply referred to as "a toner".

2. Description of the Related Art

Image-forming devices such as an electrophotographic device, an electrostatic recording device, an electrostatic printing device and so on are applied to a copying machine, a printer, a facsimile machine, a complex machine thereof and so on. A method to form a desired image by developing a latent image of electrostatics formed on a photosensitive member with a toner for developing electrostatic image is widely used.

For example, an electrophotographic device using an electrophotography uniformly charges a surface of a photosensitive member generally formed of a photoconductive material with any means used generally, then, a latent image of electrostatics is formed on the photosensitive member. Next, the latent image of electrostatics is developed with the use of a toner. After transferring an image of the toner on a transferring material such as paper or the like, the image is fixed by a method such as heating or the like. Thus, a copy is obtained.

Conventionally, a toner produced by a pulverization method, which is a toner (pulverized toner) obtained by mixing and kneading a binder resin obtained by polymerizing a polymerizable monomer, a colorant and so on followed by pulverizing and classifying, has been generally used. However, the pulverization method has problems of decrease in yield, large energy consumption in pulverization and so on, particularly when producing a toner with a small particle diameter. In order to solve these problems, a toner produced by a polymerization method, a polymerized toner, has been proposed. The polymerized toner are likely to be small in diameter, have uniform form and have narrow size distribution, thus is excellent in printing performance in comparison with pulverized toner.

As a method of producing the polymerized toner, there may be a suspension polymerization method, an emulsion agglomeration method, a dispersion polymerization method and so on. For example, in the suspension polymerization method, firstly, a polymerizable monomer, a colorant, and if required, other additives are mixed to prepare a polymerizable monomer composition, and the polymerizable monomer composition is dispersed in an aqueous dispersion medium containing a dispersion stabilizer followed by agitation with a high-speed agitator or the like to form droplets of the polymerizable monomer composition. Next, the polymerizable monomer composition formed as the droplets is polymerized in the presence of a polymerization initiator followed by washing, filtering, dehydrating and drying, thus, colored resin particles are obtained. Further, the colored resin particles are mixed with an external additive such as an inorganic fine particle or the like to obtain a polymerized toner. If required, the polymerized toner is mixed with a carrier to obtain a two-component developer.

In the above production process of the polymerized toner, some additives added as required disturb polymerization reaction of the polymerizable monomer. An unreacted polymerizable monomer remaining in the toner has been a problem. Also, besides the unreacted polymerizable monomer, it has been a problem that a decomposed product of a polymerization initiator is obtained as a by-product by polymerization using the polymerization initiator and remains in the toner.

If the unreacted polymerizable monomer and the decomposed product of the polymerization initiator remain in the toner, volatiles derived from the unreacted polymerizable monomer and the decomposed product of the polymerization initiator volatilize by heating upon fixing and odor is produced so that surrounding environment is deteriorated. Further, the toners become fusible each other upon storing the toner resulting in blocking, thus causing decrease in shelf stability of the toner and adverse effect on printing performance of the toner.

With respect to the above problem, production of odor upon fixing has been tried to be diminished. For example, Japanese Patent Application Laid-Open (JP-A) No. 2000-321809 suggests a method of producing a toner including a process of stripping treatment under reduced pressure (removal of unreacted polymerizable monomer) with a dispersion liquid containing a colored resin particle after suspension polymerization and discloses t-butylperoxy-2-ethylhexanoate (product name: PERBUTYL O; manufactured by NOF Corporation) as a polymerization initiator.

JP-A No. 2001-117272 suggests a method of producing a toner including a process of stripping treatment under reduced pressure (removal of unreacted polymerizable monomer) and a specific agitation condition with a dispersion liquid containing a colored resin particle after suspension polymerization and discloses t-butylperoxy-isobutylate (product name: PERBUTYL IB; manufactured by NOF Corporation) as a polymerization initiator.

JP-A No. 2000-3076 suggests a method of producing a resin for toner obtained by copolymerizing styrene and (meth) acrylic acid ester using a polymerization initiator and discloses a group consisting of dicinnamoylperoxide and tertiary alkylperoxycinnamate having 4 to 8 carbons as a polymerization initiator.

JP-A No. 2000-321809 and JP-A No. 2001-117272 focus attention on the odor derived from an unreacted polymerizable monomer and try to reduce a residual amount of the unreacted polymerizable monomer remaining in a toner by a stripping treatment under reduced pressure. However, JP-A No. 2000-321809 and JP-A No. 2001-117272 do not focus attention on the odor derived from the decomposed product of the polymerization initiator and do not sufficiently solve the problem of odor. Also, a toner disclosed in JP-A No. 2000-3076 is a pulverized toner obtained by a pulverization method. Since a production process of the toner includes mixing and kneading at high temperature, a residual amount of an unreacted polymerizable monomer remaining in the toner is relatively small, thus odor derived from an unreacted polymerizable monomer produced is considered to be small. However, JP-A No. 2000-3076 does not try to diminish the decomposed product of the polymerization initiator used and the problem of odor is not sufficiently solved. Also, the remaining decomposed product of the polymerization initiator not only produces the odor but also has effect on flowability and charging performance of toner, which causes decrease in printing durability of toner.

In addition to the problem of odor produced upon fixing, a toner is required to be excellent in printing durability so that the toner does not decline printing performance even in continuous printing of plural prints under a severe environment for using a toner such as a high temperature and humidity since use of toner in the area of high temperature and humidity is increasing in recent years. Also, a toner which is excellent in shelf stability at high temperature is required so that toners are not likely to be fusible each other even the toner is left or stored at high temperature.

As there has been such request, it has been necessary to design a toner in which change of charge amount due to environmental changes is small and which can keep a stable charge amount over time and such a toner has been discussed.

For example, JP-A No. Hei. 11 (1999)-15192 discloses a method of producing a toner wherein a polymerizable monomer is subject to suspension polymerization in a suspension medium containing a colorant and an inorganic dispersant in the presence of a quaternary ammonium base containing copolymer comprising a repeating structural unit derived from vinyl aromatic hydrocarbon, a repeating structural unit derived from (meth)acrylate and a repeating structural unit derived from quaternary ammonium base containing (meth) acrylate.

JP-A No. 11 (1999)-15192 is considered to be capable of obtaining a toner which is less likely to be fusible with other toners, can keep a stable charge amount over time to some extent and has shelf stability and printing durability been improved. However, in order to attain high-level requirement of recent years, it is considered that further study is necessary.

An object of the present invention is to provide a toner for developing electrostatic image which has a reduced residual amount of a decomposed product of a polymerization initiator remaining in the toner upon production (mainly an ether component) and an unreacted polymerizable monomer (mainly styrene), less odor produced upon fixing so as to avoid deteriorating surrounding environment, excellent shelf stability at high temperature upon storing or anti-blocking property, and excellent printing durability under both N/N environment and H/H environment upon printing.

SUMMARY OF THE INVENTION

As a result of diligent researches made to attain the above object, the inventor of the present invention found out that by obtaining a colored resin particle from polymerization in the presence of a specific polymerization initiator, a residual amount of a decomposed product of the polymerization initiator remaining in the toner upon production (mainly an ether component) and an unreacted polymerizable monomer (mainly styrene) can be reduced to be below a specific range, less odor is produced upon fixing, and by obtaining a colored resin particle from preparation of a polymerizable monomer composition with the use of a charge control resin having specific properties, change in charge amount due to environmental changes can be small, a charge amount can be stable over time, a shelf stability at high temperature upon storing or anti-blocking property is excellent, and a printing durability under both N/N environment and H/H environment upon printing can be improved, and completed the present invention based on the above knowledge.

A toner for developing electrostatic image of the present invention is a toner for developing electrostatic image comprising a colored resin particle which is obtained by polymerizing a polymerizable monomer composition containing a polymerizable monomer, a colorant and a charge control resin in an aqueous dispersion medium in the presence of a polymerization initiator, wherein the charge control resin is a quaternary ammonium base containing copolymer having a glass transition temperature "Tg" in the range from 70 to 100° C.;

the polymerization initiator is an organic peroxide; and each residual amount of an ether component and styrene remaining in the toner for developing electrostatic image is respectively less than 500 ppm and less than 50 ppm.

Also, a method of producing a toner for developing electrostatic image of the present invention is a method of producing a toner for developing electrostatic image comprising the steps of:

(1) a preparation process of a polymerizable monomer composition, in which a polymerizable monomer, a colorant, a quaternary ammonium base containing copolymer having a glass transition temperature "Tg" in the range from 70 to 100° C. as a charge control resin are mixed together to prepare a polymerizable monomer composition;

(2) a suspension process, in which after the polymerizable monomer composition is dispersed in an aqueous dispersion medium comprising a dispersion stabilizer, an organic peroxide as a polymerization initiator is added and droplets of the polymerizable monomer composition are formed so as to obtain a suspension;

(3) a polymerization process, in which a temperature of the suspension is raised for polymerization so as to obtain an aqueous dispersion liquid of a colored resin particle; and (4) a stripping process, in which the aqueous dispersion liquid of the colored resin particle is subject to a stripping treatment.

According to the toner for developing electrostatic image, a toner for developing electrostatic image which has a reduced residual amount of a decomposed product of a polymerization initiator remaining in the toner upon production (mainly an ether component) and an unreacted polymerizable monomer (mainly styrene), therefore, has less odor produced upon fixing so as to avoid deteriorating surrounding environment, an excellent shelf stability at high temperature upon storing or anti-blocking property, and an excellent printing durability under both N/N environment and H/H environment upon printing is provided.

BRIEF DESCRIPTION OF THE DRAWING

In the accompanying drawing.

Figure 1:
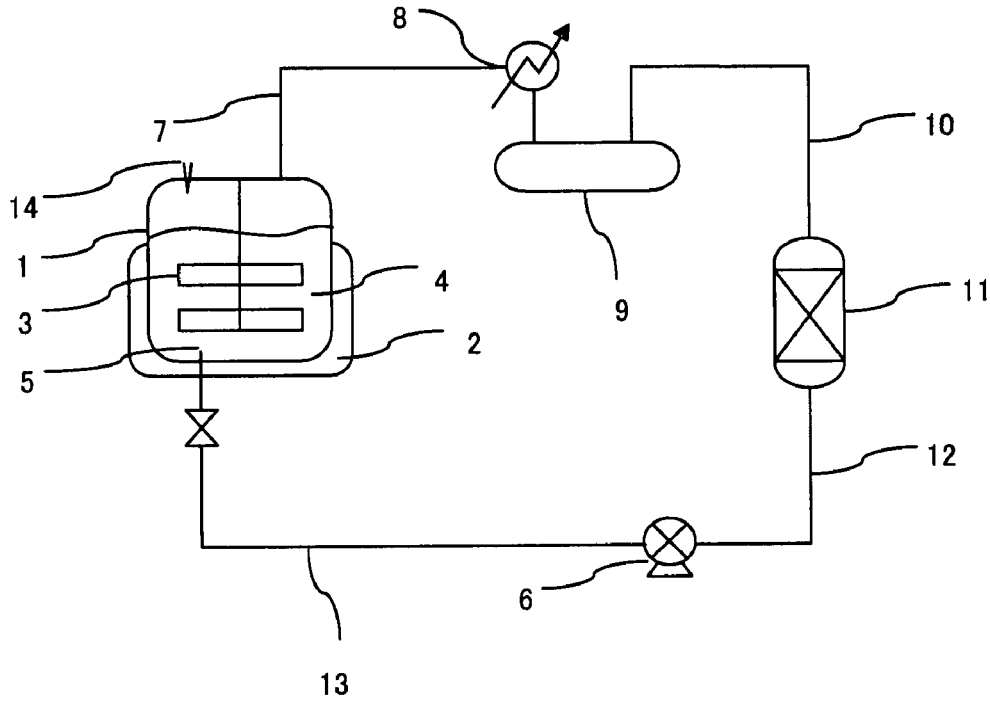
FIG. 1 is a view showing a system used in a stripping treatment process employed in Examples of the present invention.

The numerical symbol in each FIGURE refers to the following: 1. an evaporator; 2. a jacket; 3. an agitator with stirring vane; 4. an aqueous dispersion of colored resin particles; 5. a gas blowing tube; 6. a blower; 7. a gas circulation line; 8. a condenser; 9. a condensation tank; 10. a gas circulation line; 11. a removal device for volatiles; 12. a gas circulation line; 13. a gas circulation line; and 14. a noncontact bubble level meter.

DETAILED DESCRIPTION OF THE INVENTION

A toner for developing electrostatic image of the present invention is a toner for developing electrostatic image comprising a colored resin particle which is obtained by polymerizing a polymerizable monomer composition containing a polymerizable monomer, a colorant and a charge control resin in an aqueous dispersion medium in the presence of a polymerization initiator, wherein the charge control resin is a quaternary ammonium base containing copolymer having a glass transition temperature "Tg" in the range from 70 to 100° C.;

the polymerization initiator is an organic peroxide; and each residual amount of an ether component and styrene remaining in the toner for developing electrostatic image is respectively less than 500 ppm and less than 50 ppm.

Hereinafter, a toner for developing electrostatic image of the present invention and a production method thereof will be explained.

(1) Preparation Process of Polymerizable Monomer Composition

Firstly, a polymerizable monomer, a colorant, a charge control resin specified as in the present invention and other additives, if required, are mixed together to prepare a polymerizable monomer composition. A method of preparing the polymerizable monomer composition may not be particularly limited. For example, the polymerizable monomer composition can be prepared in such a manner that after the polymerizable monomer, the colorant and the charge control resin specified as in the present invention are agitated to mix by means of an agitator or the like, dispersion by means of a media type dispersing machine or the like is performed followed by adding, mixing and solving other additives, if necessary.

In the present invention, a polymerizable monomer means a compound which can be polymerized. As a main component of the polymerizable monomer, a monovinyl monomer is preferably used. As the monovinyl monomer, for example, there may be styrene; a styrene derivative such as vinyl toluene, α-methylstyrene or the like; acrylic acid and methacrylic acid; acrylic acid ester such as methyl acrylate, ethyl acrylate, propyl acrylate, butyl acrylate, 2-ethyl hexyl acrylate, dimethylaminoethyl acrylate or the like; methacrylic acid ester such as methyl methacrylate, ethyl methacrylate, propyl methacrylate, butyl methacrylate, 2-ethyl hexyl methacrylate, dimethylaminoethyl methacrylate or the like; an amide compound such as acrylamide, methacrylamide or the like; olefin such as ethylene, propylene, butylene or the like; and so on. The monovinyl monomers may be used alone or in combination. Among them, styrene, a styrene derivative, an acrylic acid derivative or methacrylic acid derivative is suitably used as the monovinyl monomer. In the present invention, "(meth)acrylic acid" refers to "methacrylic acid and acrylic acid".

In order to prevent hot offset, as a part of the polymerizable monomer, any crosslinkable polymerizable monomer may be preferably used together with the monovinyl monomer. The crosslinkable polymerizable monomer means a monomer having two or more polymerizable functional groups. As the crosslinkable polymerizable monomer, for example, there may be an aromatic divinyl compound such as divinyl benzene, divinyl naphthalene, a derivative thereof or the like; unsaturated carboxylic acid polyester of polyalcohol such as ethylene glycol dimethacrylate, diethylene glycol dimethacrylate or the like; a divinyl compound other than the above such as N,N-divinylaniline, divinyl ether or the like; a compound having three or more vinyl groups such as trimethylolpropane trimethacrylate, dimethylolpropane tetraacrylate or the like; and so on. The crosslinkable polymerizable monomers may be used alone or in combination of two or more kinds.

In the present invention, the crosslinkable polymerizable monomers may be desirably used in an amount in the range of generally from 0.1 to 5 parts by weight, preferably from 0.3 to 2 parts by weight, with respect to the monovinyl monomer of 100 parts by weight.

Further, as a part of the polymerizable monomer, any macromonomer may be preferably used together with the monovinyl monomer so that shelf stability and fixing ability at low temperature of the toner can be well-balanced. The macromonomer is a reactive oligomer or polymer which has a polymerizable carbon-carbon unsaturated double bond at the end of a polymer chain and a number average molecular weight of from 1,000 to 30,000 generally. As the macromonomer, a macromonomer which provides a polymer having higher "Tg" (glass transition temperature) than that of a polymer obtained by polymerization of the monovinyl monomer is preferable.

In the present invention, an amount of the macromonomer desirably used may be generally in the range from 0.01 to 10 parts by weight, preferably from 0.03 to 5 parts by weight, more preferably from 0.05 to 1 part by weight, with respect to the monovinyl monomer of 100 parts by weight.

A colorant is used in the present invention. To produce a colored toner, in which four types of toners including a black toner, a cyan toner, a yellow toner and a magenta toner are generally used, a black colorant, a cyan colorant, a yellow colorant and a magenta colorant may be respectively used.

In the present invention, as the black colorant, carbon black, titanium black, a magnetic powder such as zinc-ferric oxide, nickel-ferric oxide or the like may be used.

As the cyan colorant, for example, a compound such as a copper phthalocyanine pigment, a derivative thereof, an anthraquinone pigment or the like may be used. Specifically, there may be C. I. Pigment Blue 2, 3, 6, 15, 15:1, 15:2, 15:3, 15:4, 16, 17:1, 60 or the like. For good stability in polymerization and tinting strength of a toner obtained, the copper phthalocyanine pigment such as C. I. Pigment Blue 15, 15:1, 15:2, 15:3, 15:4, 17:1, or the like is preferable, and C. I. Pigment Blue 15:3 is more preferable.

As the yellow colorant, for example, a compound including an azo pigment such as a monoazo pigment, a disazo pigment or the like, a condensed polycyclic pigment and so on may be used. Specifically, there may be C. I. Pigment Yellow 3, 12, 13, 14, 15, 17, 62, 65, 73, 74, 83, 93, 97, 120, 138, 155, 180, 181, 185, 186 or the like.

As the magenta colorant, for example, a compound including an azo pigment such as a monoazo pigment, a disazo pigment or the like, a condensed polycyclic pigment and so on may be used. Specifically, there may be C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 or 251, C. I. Pigment Violet 19 or the like. For good stability in polymerization and tinting strength of a toner thus obtained, a monoazo pigment such as C. I. Pigment Red 31, 48, 57:1, 58, 60, 63, 64, 68, 112, 114, 146, 150, 163, 170, 185, 187, 206, 207 or the like may be preferable.

In the present invention, the colorants may be used alone or in combination of two or more kinds. An amount of the colorants desirably used may be preferably in the range from 1 to 10 parts by weight with respect to the monovinyl monomer of 100 parts by weight.

The charge control resin specified in the present invention is a quaternary ammonium base containing copolymer having a glass transition temperature "Tg" in the range from 70 to 100° C. The glass transition temperature "Tg" is preferably from 70 to 100° C., more preferably from 75 to 95° C. "Tg" is a value measured by Differential Scanning Calorimetry.

Since the quaternary ammonium base containing copolymer used as the charge control resin in the present invention is high in compatibility with the polymerizable monomer in comparison with a conventionally used charge control agent, agitation and mixture with the polymerizable monomer, the colorant and other additive can be suitably performed. As the result, the quaternary ammonium base containing copolymer which is the charge control resin can be uniformly dispersed in the polymerizable monomer composition so as to prepare a desirable polymerizable monomer composition. If the glass transition temperature "Tg" is in the above range, a toner excellent in shelf stability at high temperature and printing durability under environment at high temperature and humidity since a balance between shelf stability and fixing ability of the toner can be taken and the toner can accommodate change in environment of storing and use.

Also, if the glass transition temperature "Tg" of the quaternary ammonium base containing copolymer used as the charge control resin in the present invention is below the above range, shelf stability of the toner may decline and printing performance of the toner may be adversely affected. On the other hand, if the glass transition temperature "Tg" of the quaternary ammonium base containing copolymer used as the charge control resin in the present invention exceeds the above range, fixing ability of the toner may decline and printing performance of the toner may be adversely affected.

Since the toner obtained by the desirable polymerizable monomer composition has a uniform charging ability over the whole particle, deterioration of charging ability is less likely to occur even if a continuous printing is performed with plural prints and printing performance such as fog or the like is less likely to decrease. Thus, such a toner is excellent in printing durability. Further, since the toner obtained by the desirable polymerizable monomer composition has small change in charge amount imparted to the toner particle even there is change in environment of storing and use and can maintain a stable charge amount over time, printing durability is excellent under environment at normal temperature and humidity and at high temperature and humidity. In the present invention, an NN environment refers to an environment with normal temperature and humidity based on a temperature of 23° C. and a humidity of 50%, and an HH environment refers to an environment with high temperature and humidity based on a temperature of 28° C. and a humidity of 80%.

The "quaternary ammonium base containing copolymer" used as the charge control resin in the present invention is preferably a copolymer comprising a repeating structural unit having quaternary ammonium base represented by the following Formula 2:

Formula 2:

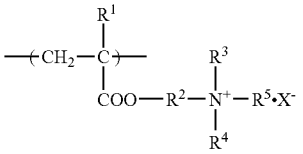

wherein, $R^1$ is a hydrogen atom or a methyl group; $R^2$ is an alkylene group having 1 to 3 carbons; each of $R^3$ to $R^5$ is independently an alkyl group having 1 to 6 carbons, a phenyl group or an aralkyl group having 1 to 12 carbons; X is a halogen atom, an alkyl sulfonate residue having 1 to 6 carbons, a benzenesulfonate residue or a paratoluene sulfonate residue.

In the present invention, a vinyl monomer unit and a (meth) acrylate monomer unit may be preferably contained as the repeating structural unit constituting the quaternary ammonium base containing copolymer besides the repeating structural unit having quaternary ammonium base represented by the Formula 2.

A containing amount of the repeating structural unit having quaternary ammonium base in the quaternary ammonium base containing copolymer is preferably in the range from 0.05 to 12 wt %, more preferably from 0.1 to 10 wt %. If the containing amount is within the above range, it is easier to control the charge amount of the quaternary ammonium base containing copolymer.

The quaternary ammonium base containing copolymer used as the charge control resin in the present invention may be produced, for example, by the following method:

1. a method to copolymerize the vinyl monomer and the quaternary ammonium base containing (meth)acrylate monomer;
2. a method to react the copolymer obtained in the above "1." with paratoluene sulfonate, methanesulfonic acid or the like; or
3. a method to quaternize a copolymer obtained by copolymerizing a vinyl monomer and a dialkylaminoalkyl (meth)acrylate monomer with a quaternization agent.

As examples of the quaternary ammonium base containing (meth)acrylate monomer, there may be N,N,N-trimethyl-N-(2-methacryloxyethyl)ammonium chloride (DMC: dimethylaminoethylmethyl methacrylate chloride), N-benzyl-N,N-dimethyl-N-(2-methacryloxyethyl)ammonium chloride (DML: dimethylaminoethylbenzyl methacrylate chloride) and so on.

As the dialkylaminoalkyl (meth)acrylate monomer, there may be dimethylaminoethyl (meth)acrylate, diethylaminoethyl (meth)acrylate, dipropylmethylaminoethyl (meth)acrylate, dibutylaminoethyl (meth)acrylate or the like.

As the quaternization agent, there may be a halogenated organic compound such as methyl chloride, methyl bromide, ethyl chloride, ethyl bromide, benzyl chloride, benzyl bromide or the like; sulfonate alkyl ester such as methyl sulfonate alkyl ester, ethyl sulfonate alkyl ester, propyl sulfonate alkyl ester, benzene sulfonate alkyl ester, paratoluene sulfonate alkyl ester or the like.

As the vinyl monomer, the vinyl aromatic hydrocarbon monomer and (meth)acrylate monomer mentioned in the above polymerizable monomer or the like is preferably used. As specific examples of the vinyl aromatic hydrocarbon monomer, there may be styrene, α-methylstyrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 2-chlorostyrene, 3-chlorostyrene, 4-chlorostyrene, 2-methyl-α-methylstyrene, 3-methyl-α-methylstyrene, 4-methyl-α-methylstyrene, 2-ethyl-α-methylstyrene, 3-ethyl-α-methylstyrene, 4-ethyl-α-methylstyrene, 2-propyl-α-methylstyrene, 3-propyl-α-methylstyrene, 4-propyl-α-methylstyrene, 2-isopropyl-α-methylstyrene, 3-isopropyl-α-methylstyrene, 4-isopropyl-α-methylstyrene, 2-chloro-α-methylstyrene, 3-chloro-α-methylstyrene, 4-chloro-α-methylstyrene, 2,3-dimethylstyrene, 3,4-dimethylstyrene, 2,4-dimethylstyrene, 2,6-dimethylstyrene, 2,3-diethylstyrene, 3,4-diethylstyrene, 2,4-diethylstyrene, 2,6-diethylstyrene, 2-methyl-3-ethylstyrene, 2-methyl-4-ethylstyrene, 2-chloro-4-methylstyrene, 2,3-dimethyl-α-methylstyrene, 3,4-dimethyl-α-methylstyrene, 2,4-dimethylstyrene, 2,6-dimethyl-α-methylstyrene, 2,3-diethyl-α-methylstyrene, 3,4-diethyl-α-methylstyrene, 2,4-diethyl-α-methylstyrene, 2,6-diethyl-α-methylstyrene, 2-ethyl-3-methyl-α-methylstyrene, 2-methyl-4-propyl-α-methylstyrene, 2-chloro-4-ethyl-α-methylstyrene and so on.

As a specific example of the (meth) acrylic acid monomer, there may be a (meth)acrylate compound not having quaternary ammonium base (hereinafter, it may be simply referred to as a (meth)acrylate compound) such as acrylic acid ester including methyl acrylate, ethyl acrylate, propyl acrylate, isopropyl acrylate, n-butyl acrylate, isobutyl acrylate, n-amyl acrylate, isoamyl acrylate, n-hexyl acrylate, 2-ethylhexyl acrylate, hydroxypropyl acrylate, lauryl acrylate or the like; methacrylic acid ester including methyl methacrylate, ethyl methacrylate, propyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, hydroxypropyl methacrylate, lauryl methacrylate or the like.

In the case of containing the vinyl aromatic hydrocarbon monomer unit and the (meth)acrylate monomer unit as the repeating structural units constituting the quaternary ammonium base containing copolymer in the present invention, a copolymerization ratio (weight ratio) thereof may be preferably in the range from 70:30 to 90:10, more preferably from 75:25 to 88:12. If the copolymerization ratio is within the above range, it is easier to obtain the quaternary ammonium base containing copolymer having Tg specified in the present invention.

As the quaternary ammonium base containing copolymer used as the charge control resin in the present invention, various commercialized products may be used. As the commercialized product, for example, there may be FCA-592P (product name; manufactured by Fujikura Kasei Co., Ltd.; Tg: 82° C.; Mw: 12,000) or the like.

A weight average molecular weight "Mw" of the quaternary ammonium base containing copolymer used as the charge control resin in the present invention may be preferably in the range from 2,000 to 50,000, more preferably from 4,000 to 40,000, even more preferably from 6,000 to 35,000. If the weight average molecular weight "Mw" of the quaternary ammonium base containing copolymer used as the charge control resin in the present invention is within the above range, the quaternary ammonium base containing copolymer can be suitably dispersed in the polymerizable monomer composition, and can obtain a toner having a stable charge amount over time.

If the weight average molecular weight "Mw" of the quaternary ammonium base containing copolymer used as the charge control resin in the present invention is less than the above range, shelf stability or printing durability of the toner may decrease. On the other hand, if the weight average molecular weight "Mw" of the quaternary ammonium base containing copolymer used as the charge control resin in the present invention exceeds the above range, fixing ability of the toner may decrease.

An added amount of the quaternary ammonium base containing copolymer used as the charge control resin in the present invention may be preferably in the range from 0.01 to 20 parts by weight, more preferably from 0.3 to 10 parts by weight, with respect to 100 parts by weight of the binder resin. Herein, the standard of 100 parts by weight of the binder resin mentioned above is nearly equal to the standard of 100 parts by weight of the polymerizable monomer and can be substituted with 100 parts by weight of the polymerizable monomer.

If the added amount of the quaternary ammonium base containing copolymer used as the charge control resin in the present invention is within the above range, shelf stability at high temperature when storing the toner and printing durability upon printing under the H/H environment can be effectively increased.

If the added amount of the quaternary ammonium base containing copolymer used as the charge control resin in the present invention is less than the above range, the charge amount imparted to the toner particle may be insufficient so that printing performance of the toner may be adversely affected. On the other hand, the added amount of the quaternary ammonium base containing copolymer used as the charge control resin in the present invention exceeds the above range, it may be difficult to control the charge amount and printing performance may lower.

As one of other additives, a release agent may be preferably added since it can improve a releasing characteristic of the toner from a fixing roller at fixing. As the release agent, one which is generally used as a release agent for the toner may be used without any particular limitation. There may be a polyolefin wax such as low-molecular-weight polyethylene, low-molecular-weight polypropylene, low-molecular-weight polybutylene or the like; a natural wax such as candelilla, a carnauba wax, a rice wax, a haze wax, jojoba or the like; a petroleum wax such as paraffin, microcrystalline, petrolactam or the like; a mineral wax such as montan, ceresin, ozokerite or the like; a synthesized wax such as a Fischer-Tropsch wax or the like; an esterified compound of polyalcohol including pentaerythritol ester such as pentaerythritol tetramyristate, pentaerythritol tetrapalmitate, pentaerythritol tetrastearate, pentaerythritol tetralaurate or the like, dipentaerythritol ester such as dipentaerythritol hexamyristate, dipentaerythritol hexapalmitate, dipentaerythritol hexylaurate or the like; and so on. Among them, the esterified compound of polyalcohol is preferable since it can improve the low-temperature fixing ability of the toner and cannot deteriorate printing durability. The esterified compounds may be used alone or in combination of two or more kinds.

In the present invention, an amount of the release agent desirably used may be generally in the range from 0.1 to 30 parts by weight, preferably from 1 to 20 parts by weight, with respect to the monovinyl monomer of 100 parts by weight.

As one of other additives, a molecular weight modifier may be preferably used. As the molecular weight modifier, there may be mercaptans such as t-dodecyl mercaptan, n-dodecyl mercaptan, n-octyl mercaptan, 2,2,4,6,6-pentamethylheptane-4-thiol or the like; thiuram disulfides such as tetramethyl thiuram disulfide, tetraethyl thiuram disulfide, tetrabutyl thiuram disulfide, N,N'-dimethyl-N,N'-diphenyl thiuram disulfide, N,N'-dioctadecyl-N,N'-diisopropyl thiuram disulfidell or the like; and so on. The molecular weight modifier may be added prior to or during polymerization.

In the present invention, an amount of the molecular weight modifier desirably used may be generally in the range from 0.01 to 10 parts by weight, preferably from 0.1 to 5 parts by weight, with respect to the monovinyl monomer of 100 parts by weight.

(2) Suspension Process of Obtaining Suspension (Droplets Forming Process)

The polymerizable monomer composition thus obtained in "(1) Preparation process of polymerizable monomer composition" is dispersed in an aqueous dispersion medium comprising a dispersion stabilizer. After addition of a polymerization initiator specified of the present invention, droplets of the polymerizable monomer composition are formed. If necessary, the molecular weight modifier and the cross-linkable polymerizable monomer may be added after the polymerization initiator specified in the present invention is added.

The timing of adding the polymerization initiator specified in the present invention may not be particularly limited. For instance, the polymerization initiator may be preliminarily added in the polymerizable monomer composition to form droplet. However, in the present invention, it is preferable that, as mentioned above, after the polymerizable monomer composition is dispersed in the aqueous dispersion medium containing the dispersion stabilizer and after forming droplets, the polymerization initiator specified in the present invention is added to form droplets.

The method of forming droplets may not be particularly limited. For example, droplets may be formed by means of a device capable of high dispersion such as MILDER MDN303V (product name; manufactured by: Pacific Machinery & Engineering Co., Ltd.), MILDER (product name; manufactured by Ebara Corporation) or the like as an in-line type emulsifying and dispersing machine, T. K. HOMOMIXER MARK II (product name; manufactured by PRIMIX Corporation) as a high-speed emulsification dispersing machine, CAVITRON CD 1000 (product name; manufactured by Pacific Machinery & Engineering Co., Ltd.) or the like.

The polymerization initiator specified in the present invention is organic peroxide. The organic peroxide used as the polymerization initiator in the present invention is a derivative of hydrogen peroxide (H—O—O—H) having a structure in which one or two hydrogen atoms of hydrogen peroxide are substituted by organic atomic groups. Also, since a peroxidation bond (O—O) of the organic peroxide has smaller bond energy than other bonds such as "C—H", "C—C", "C—O" and so on, the peroxidation bond (O—O) is easily decomposed (cleaved) by heating or the like and an oxygen radical (O.) of the organic peroxide is produced. The produced oxygen radical (O.) of the organic peroxide reacts with the polymerizable monomer to proceed the polymerization reaction.

The organic peroxide which is the polymerization initiator not only has effect to react with the polymerizable monomer due to decomposing (cleaving) of the peroxidation bond (O—O) and proceed the polymerization reaction but also produces the decomposed product of the polymerization initiator (mainly an ether component) as by-product which remains in the toner to cause odor. Herein, the "ether component" which is a main component of the decomposed product of the polymerization initiator means a volatile ether component causing odor, specifically, a monoether component having one ether bond in one molecule of the decomposed product of the polymerization initiator but it does not include a polyether component having plural ether bonds in one molecule of the decomposed product of the polymerization initiator.

The above organic peroxide can be classified by chemical structure into seven kinds: a hydroperoxide compound (Formula 3), a dialkylperoxide compound (Formula 4), a peroxy ester compound (Formula 1, an alkylperester compound), a diacylperoxide compound (Formula 5), a peroxydicarbonate compound (Formula 6), a peroxyketal compound (Formula 7) and a ketone peroxide compound (Formula 8) represented by the following formulae, Formula 3:

Formula 4:

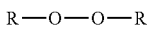

-continued

Formula 1:

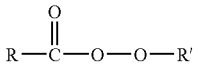

Formula 5:

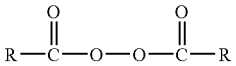

Formula 6:

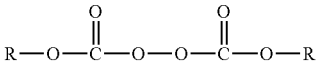

Formula 7:

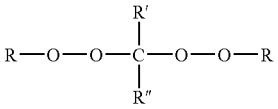

Formula 8:

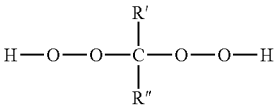

wherein, each of R, R', R" may be an alkyl group or other organic group and may be the same or different with each other.

Among the above seven organic peroxides, the polymerization initiator used in the present invention is preferably the peroxy ester compound represented by the Formula 1 since the peroxy ester compound represented by the Formula 1 has a very high effect in decreasing residual amount of the decomposed product of the polymerization initiator (mainly ether component) and the unreacted polymerizable monomer (mainly styrene) remaining in the toner:

Formula 1:

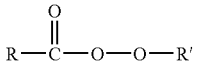

wherein, each of R and R' is an alkyl group.

As the specific example of the peroxy ester compound preferably used as the polymerization initiator in the present invention, there may be t-butylperoxy-2-ethylbutanoate (product name: TRIGONOX 27 (Formula 9); manufactured by Akzo Nobel N.V.; molecular weight: 188; purity: 98%; one-hour half-life temperature: 94° C.), t-butylperoxy-2-ethylhexanoate (product name: PERBUTYL O (Formula 10); manufactured by NOF Corporation; molecular weight: 216; purity: 97%; one-hour half-life temperature: 92° C.), t-hexylperoxy-2-ethylhexanoate (product name: perhexyl O (Formula 11); manufactured by NOF Corporation; molecular weight: 244; purity: 90%; one-hour half-life temperature: 90° C.), 1,1,3,3-tetramethylbutylperoxy-2-ethylhexanoate (product name: perocta O (Formula 12); manufactured by NOF Corporation; molecular weight: 272; purity: 90%; one-hour half-life temperature: 84° C.), t-butylperoxy-pivalate (product name: perbutyl PV (Formula 13); manufactured by NOF Corporation; molecular weight: 174; purity: 70%; one-hour half-life temperature: 73° C.), t-hexylperoxy-pivalate (product name: perhexyl PV (Formula 14); manufactured by NOF Corporation; molecular weight: 202; purity: 70%; one-hour half-life temperature: 71° C.) represented by the following formulae or the like:

Formula 9:

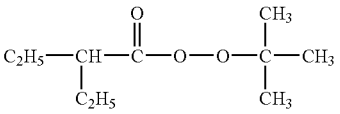

Formula 10:

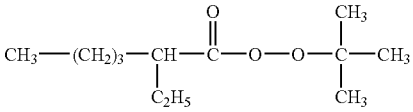

Formula 11:

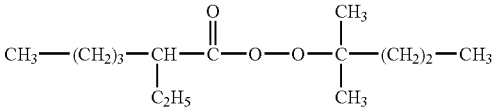

Formula 12:

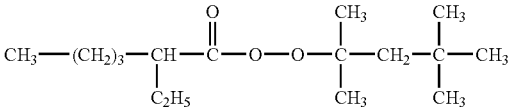

Formula 13:

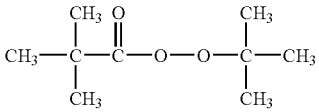

Formula 14:

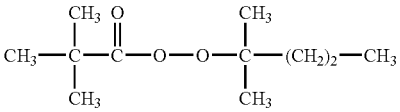

In the case of using the peroxy ester compound as the polymerization initiator in the present invention, a presumed structure of the by-produced decomposed product of the polymerization initiator may be, for example, a decomposed product represented by the following Formula 15 if TRIGONOX 27 (Formula 9) is used:

Formula 15:

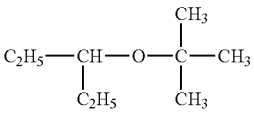

Also, if PERBUTYL O (Formula 10) is used, a decomposed product represented by the following Formula 16 may be presumed:

Formula 16:

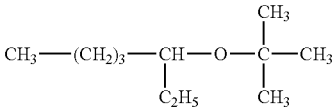

Further, carbon number of R and R' in the peroxy ester compound represented by the Formula 1 is preferably 6 or less, more preferably 5 or less. If the carbon number of R and R' in the peroxy ester compound represented by the Formula 1 exceeds the above range, the boiling point of the decomposed product of the polymerization initiator becomes so high that it may be difficult to remove the decomposed product from the toner.

As the specific example of peroxy ester compound represented by Formula 1 in which carbon number of R and R' is 6 or less preferably used as the polymerization initiator in the present invention, there may be t-butylperoxy-2-ethylbutanoate (Formula 9), t-butylperoxy-pivalate (Formula 13), t-hexylperoxy-pivalate (Formula 14) or the like.

A molecular weight of the organic peroxide used as the polymerization initiator in the present invention is preferably 205 or less. If the molecular weight of the organic peroxide used as the polymerization initiator in the present invention is within the above range, since the molecular weight of the by-produced decomposed product of the polymerization initiator (mainly ether component) can be relatively small, the decomposed product of the polymerization initiator can be easily removed by performing the below mentioned stripping treatment with the colored resin particle having the decomposed product of the polymerization initiator remained.

If the molecular weight of the organic peroxide used as the polymerization initiator in the present invention exceeds the above range, since the molecular weight of the by-produced decomposed product of the polymerization initiator (mainly ether component) may be relatively large, it may be difficult to remove the decomposed product of the polymerization initiator even by performing the below mentioned stripping treatment with the colored resin particle having the decomposed product of the polymerization initiator remained.

A purity of the organic peroxide used as the polymerization initiator in the present invention is preferably 90% or more, more preferably 95% or more, even more preferably 97% or more. If the purity of the organic peroxide used as the polymerization initiator in the present invention is below the above range, impurity, diluent of the polymerization initiator and so on which are mixed upon producing the polymerization initiator may remain in the toner to decrease printing performance of the toner. Also, polymerization rate may decrease.

An one-hour half-life temperature of the organic peroxide used as the polymerization initiator of the present invention is preferably in the range from 70° C. to 100° C., more preferably from 75° C. to 95° C. The half life of the organic peroxide is a period of time when a concentration of the organic peroxide being a polymerization initiator is halved from an initial concentration. The half-life temperature is a temperature wherein a half life is one hour and is an indicator showing easiness of occurrence of the cleavage of the peroxidation bond (O—O) of the organic peroxide and produce radical.

If the one-hour half-life temperature of the organic peroxide used as the polymerization initiator in the present invention is below the above range, the polymerization rate may be higher so as to be difficult to control reaction. If the one-hour half-life temperature exceeds the above range, the polymerization rate may be lowered so as to take longer polymerization time.

An added amount of the organic peroxide used as the polymerization initiator in the present invention is preferably in the range from 0.1 to 15 parts by weight, more preferably from 0.5 to 10 parts by weight, even more preferably from 1 to 7 parts by weight, with respect to 100 parts by weight of the monovinyl monomer. If the added amount of the organic peroxide used as the polymerization initiator in the present invention is within the above range, a polymerization reaction mentioned hereinafter may be suitably performed and the residual amounts of the decomposed product of the polymerization initiator (mainly ether component) and unreacted polymerizable monomer (mainly styrene) remained in the obtained colored resin particle can be decreased.

In the present invention, an aqueous dispersion medium may be water alone but a water-soluble solvent such as lower alcohol, lower ketone or the like may be used together. A dispersion stabilizer is preferably contained in the aqueous dispersion medium for use. As the dispersion stabilizer, for example, there may be a metallic compound and so on including sulfate such as barium sulfate, calcium sulfate or the like; carbonate such as barium carbonate, calcium carbonate, magnesium carbonate or the like; phosphate such as calcium phosphate or the like; metallic oxide such as aluminum oxide, titanium oxide or the like; metallic hydroxide such as aluminum hydroxide, magnesium hydroxide, ferric hydroxide or the like; and so on. As the dispersion stabilizer, there may be also an organic compound including a water-soluble polymer such as polyvinyl alcohol, methyl cellulose, gelatin or the like; an anionic surfactant; nonionic surfactant; an ampholytic surfactant; and so on. The dispersion stabilizer may be used alone or in combination of two or more kinds.

Among the dispersion stabilizer, the metallic compound, particularly, the dispersion stabilizer containing colloid of hardly water-soluble metal hydroxide is preferable since the particle distribution of the colored resin particle can be narrowed and the residual amount of the dispersion stabilizer remaining in the colored resin particle after washing can be small so that the polymerized toner to be obtained can reproduce clear image, particularly, image quality under the H/H environment is less likely to deteriorate.

(3) Polymerization Process

A temperature of the desired suspension (the aqueous dispersion medium containing droplets of the polymerizable monomer composition) obtained in "(2) Suspension process of obtaining a suspension (droplets forming process)" is raised to polymerize in the presence of the polymerization initiator specified of the present invention.

In the present invention, polymerization temperature is preferably 50° C. or more, more preferably from 60 to 95° C. Polymerization reaction time is preferably from 1 to 20 hours, more preferably from 2 to 15 hours. In order to polymerize droplets of the polymerizable monomer composition in a state of being stably dispersed, the polymerization reaction may proceed while agitating the droplets for dispersion treatment in the polymerization process continuously following the "(2) Suspension process of obtaining suspension (droplets forming process)".

In the present invention, it is preferable to form so-called core-shell type (or "capsule type") colored resin particles, which can be obtained by using the colored resin particles obtained by the polymerization process as a core layer and forming a shell layer, a material of which is different from that of the core layer, around the core layer. The core-shell type colored resin particles can take a balance of lowering of fixing temperature and prevention of blocking at storage of a polymerized toner by covering the core layer comprising a substance having a low-softening point with a substance having a high softening point.

A method for producing the core-shell type colored resin particles mentioned above may not be particularly limited, and may be produced by a conventional method. An in situ polymerization method or a phase separation method is preferable from the viewpoint of production efficiency.

The method of producing the core-shell type colored resin particles according to the in situ polymerization method will be hereinafter described.

A polymerizable monomer (a polymerizable monomer for shell) for forming a shell layer and a polymerization initiator for shell are added to an aqueous dispersion medium to which the above-mentioned colored resin particles to be a core particle are dispersed followed by polymerization, thus the core-shell type colored resin particles can be obtained.

As a polymerizable monomer for shell, the above-mentioned polymerizable monomer or the like can be similarly used. Among them, a monomer which provides a polymer having "Tg" of more than 80° C. such as styrene, methyl methacrylate or the like may be preferably used alone or in combination of two or more kinds.

As a polymerization initiator for shell used for polymerization of the polymerizable monomer for shell, there may be polymerization initiators such as a metal persulfate including potassium persulfate, ammonium persulfate or the like; a water-soluble azo compound such as 2,2'-azobis-([2-methyl-N-(2-hydroxyethyl)propionamide], 2,2'-azobis-[2-methyl-N-(1,1-bis(hydroxymethyl)-2-hydroxy ethyl)propionamide] or the like; and so on. In the present invention, an amount of the polymerization initiator for shell is preferably from 0.1 to 30 parts by weight, more preferably from 1 to 20 parts by weight with respect to the polymerizable monomer for shell of 100 parts by weight.

A polymerization temperature of the shell layer is preferably 50° C. or more, more preferably from 60 to 95° C. Also, the polymerization time of the shell layer is preferably in the range from 1 to 20 hours, more preferably from 2 to 15 hours.

(4) Stripping Process

In the above "(3) Polymerization process", by using the polymerization initiator specified in the present invention, the polymerization reaction is suitably performed and the residual amount of the decomposed product of the polymerization initiator (mainly ether component) and unreacted polymerizable monomer (mainly styrene) remaining in the colored resin particle to be obtained can be decreased.

Further, in the present invention, if the decomposed product of the polymerization initiator (mainly ether component) and unreacted polymerizable monomer (mainly styrene) remain in the colored resin particle to be obtained even in small amount, it is preferable that the aqueous dispersion liquid of the colored resin particle obtained by the "(3) Polymerization process" is subject to the stripping treatment in order to efficiently remove volatiles (mainly ether component and styrene) which cause odor.

A stripping treatment system used in the present invention will be explained hereinafter.

As shown in FIG. 1, the stripping treatment system facilitates gas circulation lines (7, 10, 12 and 13) outside, and each gas circulation line comprises a blower 6, a condenser 8, a condensation tank 9 and a removal device for volatiles 11. An evaporator 1 of the stripping treatment system comprises an agitator 3 with stirring vane to agitate an aqueous dispersion 4 of colored resin particles inside of the evaporator 1. The evaporator 1 may be the same as the container (reactor) used in the polymerization process or may be different. On the outside of the evaporator 1, a jacket 2 for heating or cooling may be disposed.

Firstly, the aqueous dispersion liquid of the colored resin particle obtained by the "(3) Polymerization process" is diluted by the ion-exchange water so that the concentration of solid content of the colored resin particle is in the range from 10 to 30 wt %. An aqueous dispersion liquid 4 of the colored resin particle having the concentration of solid content adjusted is charged in the evaporator 1. If necessary, a defoaming agent is added in the evaporator 1. The stripping treatment is performed, heating is performed while stirring with an agitator 3 with stirring vane and remaining volatiles remaining in the colored resin particles (mainly an ether component and styrene) can be removed.

As the stripping treatment, there may be a method of blowing gas to the aqueous dispersion 4 of colored resin particles; a method of blowing saturated vapor to the aqueous dispersion 4 of colored resin particles; and a method of depressurizing the aqueous dispersion 4 of colored resin particles. Among them, the method of blowing gas to the aqueous dispersion 4 of colored resin particles is preferable. When employing the method of blowing gas, the gas includes nitrogen, an inert gas of carbon dioxide or the like, air and so on. Among them, nitrogen is preferable. The gas may be blown to a gas phase part of the evaporator 1 (onto the surface of the aqueous dispersion 4 of colored resin particles). However, it is preferable to blow the gas into the aqueous dispersion 4 of colored resin particles.

After completing the stripping treatment, foam formation is likely to occur on the surface of the aqueous dispersion 4 of colored resin particles. If forms are overproduced and the aqueous dispersion 4 of colored resin particles spills from the evaporator 1, it flows into the gas circulation line 7 so as to contaminate. For this reason, it is preferable to use a defoaming agent with an effect of inhibiting foam formation. As the defoaming agent, there may be a fatty oil-based defoaming agent, a mineral oil-based defoaming agent, a polyether defoaming agent, a polyalkylene glycol-contained nonionic surfactant or the like. An amount of the defoaming agent to be added is preferably from 0.01 to 1 part by weight, more preferably from 0.05 to 0.5 parts by weight with respect to the colored resin particle of 100 parts by weight.

In order to remove remaining volatiles remaining in the colored resin particles (mainly ether component and styrene) by using the stripping treatment system, a temperature of the stripping treatment is preferably a glass transition temperature (Tg) of a binder resin comprising the colored resin particles or more and less than (Tg+75)° C., more preferably (Tg+10)° C. or more and less than (Tg+65)° C.

Time required for the stripping treatment may be appropriately determined depending on the scale of a stripping treatment system (treatment ability) and amounts of volatiles remaining in the colored resin particles (mainly ether component and styrene). Time required for the stripping treatment may be preferably in the range from 0.5 to 40 hours, more preferably from 1 to 20 hours.

In the stripping treatment system, if the temperature and time for the stripping treatment are in the above range, the volatiles remaining in the colored resin particles (mainly ether component and styrene) can be efficiently removed.

(5) Processes of Washing, Filtering, Dehydrating and Drying

It is preferable that the aqueous dispersion of colored resin particles obtained after the stripping process (4) is subject to a series of operations including washing, filtering, dehydrating, and drying several times as needed according to a conventional method.

Firstly, in order to remove the dispersion stabilizer remained in the aqueous dispersion of colored resin particles, acid or alkali is added to the aqueous dispersion to wash. If the dispersion stabilizer is an acid-soluble inorganic compound, acid is added to the aqueous dispersion of colored resin particles. On the other hand, if the dispersion stabilizer is an alkali-soluble inorganic compound, alkali is added to the aqueous dispersion of colored resin particles.

When using an acid-soluble inorganic compound as the dispersion stabilizer, it is preferable to control pH of the aqueous dispersion of colored resin particles to 6.5 or less by adding acid. It is more preferable to control pH to 6 or less. As the acid to be added, an inorganic acid such as a sulfuric acid, a hydrochloric acid, a nitric acid or the like, or an organic acid such as a formic acid, acetic acid or the like may be used. Among them, the sulfuric acid is particularly preferable for high removal efficiency and small impact on production facilities.

After the above acid or alkali washing, a washing treatment (washing, filtering and dewatering) is performed using cleaning water such as ion-exchange water or the like followed by a drying treatment. As methods of washing, various known methods can be used and may not be particularly limited. For example, there may be a centrifugal filtration, a pressure filtration, a vacuum filtration or the like. As a washing device, a peeler centrifuge, a siphon peeler centrifuge or the like may be used for the washing treatment (washing, filtering and dehydrating). A method of drying may not be particularly limited also, and various known methods can be used. For example, various methods such as vacuum drying, flash drying, a spray dryer and so on may be used.

(6) Colored Resin Particles

The residual amount of the decomposed product of the polymerization initiator (mainly ether component) and unreacted polymerizable monomer (mainly styrene) remaining in the colored resin particle obtained by the above "(5) Processes of washing, filtering, dehydrating and drying" can be very small and odor derived from volatiles (mainly ether component and styrene) is produced very little upon printing using the obtained toner.

The colored resin particle comprising the toner will be hereinafter described. Hereinafter, the colored resin particle includes both core-shell type colored resin particle and colored resin particle which are not core-shell type.

A volume average particle diameter "Dv" of the colored resin particles comprising the toner for developing an electrostatic image of the present invention may be preferably in the range from 3 to 15 μm, more preferably from 4 to 12 μm. If "Dv" is less than the above range, flowability of the toner lowers, transferability of the toner may deteriorate, blur may generate, or printing density may lower. If "Dv" exceeds the above range, resolution of an image to be obtained may decline.

In the present invention, a number percentage of particle diameter of the colored resin particle of 5 μm or less is preferably 25% or less, more preferably 18% or less. If the number percentage of particle diameter of the colored resin particle of 5 μm or less exceeds the above range, flowability of the toner to be obtained may decrease, transferability of the toner may deteriorate. As a result, blur may generate and printing density may decline.

As for the colored resin particles in the present invention, a size distribution, which is a ratio "Dv/Dp" of a volume average particle diameter "Dv" and a number average particle size "Dp", may be preferably in the range from 1.0 to 1.3, more preferably from 1.0 to 1.2. If the size distribution "Dv/Dp" of the colored resin particles in the present invention exceeds the above range, flowability of the toner to be obtained lowers, transferability may decline; blur may generate, printing density may decline. The volume average particle diameter "Dv" and the number average particle size "Dp" of the colored resin particles may be measured, for example, by means of a particle diameter measuring device (product name: MULTISIZER; manufactured by Beckman Coulter, Inc.) or the like.

An average circularity of the colored resin particles in the present invention is preferably in the range from 0.960 to 0.995, more preferably from 0.970 to 0.995. In the present invention, circularity is a value obtained by dividing a perimeter of a circle having an area same as a projected image of a particle by a perimeter of a particle image. Also, in the present invention, an average circularity is used as a simple method of presenting a shape of a particle quantitatively and is an indicator showing the level of convexo-concave shapes of the colored resin particle. The average circularity is "1" when the colored resin particles is an absolute sphere, and becomes smaller as the shape of the surface of the colored resin particles becomes more complex. In order to obtain the average circularity (Ca), firstly, circularity (Ci) of each of measured "n" particles of 0.6 μm or more by a diameter of the equivalent circle is calculated by the following Calculation formula 1. Next, the average circularity (Ca) is obtained by the following Calculation formula 2.

Calculation Formula 1:

circularity (Ci)=a perimeter of a circle having an area same as a projected area of a particle image/a perimeter of a particle image Calculation formula 2

$$Ca = \frac{\sum_{i=1}^{n} (Ci \times fi)}{\sum_{i=1}^{n} (fi)}$$

In the Calculation formula 2, "fi" is a frequency of a particle of circularity (Ci).

The above-mentioned circularity and average circularity may be measured by means of a flow particle image analyzer FPIA-2000, FPIA-2100 or FPIA-3000 (product name; manufactured by Sysmex Co.) or the like.

If the average circularity of the colored resin particles exceeds the above range, the colored resin particles can easily pass through between a cleaning blade and a photosensitive member so that cleaning problems such as filming on the photosensitive member or fog of printed image is likely to occur. If the average circularity of the colored resin particles is less than the above range, reproductivity of thin lines may decrease.

The colored resin particles obtained in the present invention may be a toner for developing an electrostatic image as it is or a toner for developing an electrostatic image by adding carrier particles (ferrite, iron powder or the like). Also, the colored resin particles and an external additive may be mixed by means of a high-speed agitator such as HENSCHEL MIXER (product name; manufactured by: Mitsui Mining Co., Ltd.) or the like to form a one-component toner in order to control charge property, flowability, shelf stability or the like of a toner. Further, in addition to the colored resin particles and the external additive, carrier particles may be mixed to form a two-component developer.

As the external additive, there may be inorganic microparticles such as silica, titanium oxide, aluminum oxide, zinc oxide, tin oxide, calcium carbonate, calcium phosphate, cerium oxide or the like; and organic microparticles comprising a polymethyl methacrylate resin, silicone resin, melamine resin or the like. Among them, the inorganic microparticles are preferable. Silica and titanium oxide are more preferable, and silica is still more preferable. Further, as the external additive, two or more kinds of microparticles may be preferably used in combination. In the present invention, an amount of the external additive desired to be used is generally in the range from 0.1 to 6 parts by weight, preferably from 0.2 to 5 parts by weight, with respect to the colored resin particles of 100 parts by weight.

(7) Toner

The toner obtained through the above steps from (1) to (6) is obtained through the preparation of the polymerizable monomer composition using the charge control resin having specific characteristics, a suitable polymerization reaction using a specific polymerization initiator, and preferably the stripping treatment. Therefore, the residual amount of the decomposed product of the polymerization initiator (mainly ether component) and unreacted polymerizable monomer (mainly styrene) remaining in the toner can be lowered below a specific amount.

In the present invention, it is preferable that a residual amount of the ether component remaining in the toner is less than 500 ppm, preferably less than 200 ppm, more preferably less than 50 ppm. If the residual amount of the ether component remaining in the toner is in the above range, odor derived from the decomposed product of the polymerization initiator (mainly ether component) produced upon fixing can be decreased in very small amount so that the surrounding environment is not deteriorated.

It is preferable that the residual amount of styrene remaining in the toner of the present invention is less than 50 ppm, more preferably less than 30 ppm, even more preferably less than 20 ppm. If the residual amount of styrene remaining in the toner is within the above range, the odor derived from unreacted polymerizable monomer (mainly styrene) produced upon fixing can be reduced to a very small amount, surrounding environment may not be deteriorated, toners are less likely to be fusible with each other upon storage and shelf stability at high temperature (anti-blocking property) can be excellent.

Since the toner of the present invention is obtained by the suitable polymerization reaction using the specific polymerization initiator and preferably by the stripping treatment, the residual amount of the decomposed product of the polymerization initiator (mainly ether component) and unreacted polymerizable monomer (mainly styrene) remaining in the toner causing odor produced at fixing can be reduced below the specific amount, the toner of the present invention is a toner which does not deteriorate surrounding environment and takes environment into account.

Also, since the toner of the present invention is obtained by preparing the polymerizable monomer composition using the charge control resin having the specific properties, change of charge amount due to environmental changes is small, a stable charge amount can be maintained over time, shelf stability at high temperature (anti-blocking property) is excellent at storage, deterioration of image due to fog or the like is less likely to occur upon continuous printing of plural prints not only under the N/N environment at printing but also under the H/H environment (printing durability is excellent). Therefore, the toner of the present invention is a toner which meets the requirement of increased variation of storage environments and using environments of the toner and the requirement of decrease in printing cost.

EXAMPLES

Hereinafter, the present invention will be explained further in detail with reference to examples and comparative examples. However, the scope of the present invention may not be limited to the following examples. Herein, "part(s)" and "%" are based on weight if not particularly mentioned. Test methods used in the examples and the comparative examples are as follows.

(1) Glass Transition Temperature

About 10 mg of test sample (a charge control resin) was weighed and, in accordance with ASTM D3418-97 using a Differential Scanning Calorimetry (product name: SSC5200; manufactured by: Seiko Instruments, Inc.), charged into an aluminum pan. Measurement of the glass transition temperature (Tg) of the test sample (the charge control resin) was performed using an empty aluminum pan as a reference under the condition of the temperature in the range from 0 to 150° C. and a heating rate of 10° C./min.

(2) Particle Diameter of Colored Resin Particle

The volume average particle diameter "Dv" and the number average particle diameter "Dp" of the colored resin particle were measured by means of a particle diameter measuring device (product name: MULTISIZER; manufactured by: Beckman Coulter, Inc.). Measurement by means of MULTISIZER was carried out under the condition of an aperture diameter of 100 μm, using ISOTON II (product name; manufactured by Beckman Coulter, Inc.) as a medium, and a number of the measured particles of 100,000. More specifically, a colored resin particle sample of 0.2 g was charged into a beaker adding an aqueous solution of alkyl benzene sulfonate (product name: DRIWEL; manufactured by: Fuji film Corporation) of 0.5 ml as a dispersing agent. Further, 2 ml of the medium was added to the beaker to moist the colored resin particle. 10 ml of the medium was added. The mixture was dispersed by means of an ultrasonic disperser for 1 minute and was subject to measurement by means of the above particle diameter measuring device.

(3) Residual Amounts of Ether Component and Styrene

The toner was precisely weighed to be 3 g up to the unit of 1 mg. 27 g of ethyl acetate was added to the weighed toner of 3 g and agitated for 15 minutes. Then, 13 g of methanol was added thereto and agitated for another 10 minutes. A solution thus obtained was left to precipitate insoluble contents. A supernatant liquid of the solution was taken as a measurement sample and 2 μl thereof was charged into a gas chromatograph to quantitate an ether component and styrene.

Measurement conditions of the gas chromatograph are as follows. A column (product name: DB-5; manufactured by: Agilent Technologies) with an inside diameter of 0.25 mm and a length of 30 m was used. The column was kept at 40° C. for three minutes. Then, the temperature was increased to 130° C. at a pace of 10° C. per minute and further increased to 230° C. at a pace of 20° C. per minute so that an injection temperature was 200° C. and a FID detection temperature was 250° C. As a standard sample for quantitative determination, an ethyl acetate/methanol solution of each component was used.

(4) Evaluation of Shelf Stability at High Temperature

A container charged with a toner of 20 g was hermetically closed and sunk in a constant temperature water bath kept at 60° C. The container was removed therefrom after five hours. The toner was transferred from the container onto a 42 mesh screen while being kept from vibration and set on a powder characteristics measuring device (product name: POWDER CHARACTERISTICS TESTER PT-R; manufactured by: Hosokawa Micron Corporation). The screen was vibrated at amplitude of 1.0 mm for 30 seconds. A weight of the toner remained on the screen was measured and referred to as a weight of the aggregated toner. Shelf stability rate (%) of the toner at high temperature was calculated from the ratio (% by weight) of the weight of the toner remained on the screen (corresponding to the weight of the aggregated toner) with respect to the weight of the toner measured (20 g). As the value of the shelf stability rate (%) of the toner at high temperature becomes smaller, the toner is less aggregated and more excellent in shelf stability at high temperature.

(5) Continuous Printing Test (N/N Environment, H/H Environment)

A commercially available printer of a non-magnetic one-component developing method (printing speed: 22 prints per minute) was charged with printing papers and inserted with a cartridge charged with a toner. After the printer was left under a N/N (normal temperature and humidity) environment having a temperature of 23° C. and a humidity of 50% for one day, continuous printing with 1% printing density was performed under the N/N environment. A solid patterned image with 0% image density was printed every 1,000 prints to measure a fog value. Number of sheets was counted while the image quality having the fog value of 1.0 or less is maintained when solid patterned images with 0% printing density were printed. The continuous printing test was performed up to 20,000 sheets but when fog is generated in mid-course, the continuous printing test was stopped at the time.

The fog value was measured as follows. After solid pattern printing with 0% image density of the first page was performed with the printer followed by stopping solid pattern printing at the tenth page, the toner of a nonimage area remained on the photosensitive member after developing was attached to an adhesive tape (product name: SCOTCH MENDING TAPE 810-3-18; manufactured by: Sumitomo 3M Limited). The tape was attached to a new printing paper, and color tone was measured by means of a spectrophotometer (product name: SE-2000; manufactured by: NIPPON DENSHOKU INDUSTRIES CO., LTD.). As a reference (or a benchmark sample), an unused tape was attached to a printing paper so as to measure a color tone in the same manner. Each color tone was referred as a coordinate of L*a*b* space, and color difference ΔE was calculated from the color tones of the sample for measurement and the benchmark sample. The color difference ΔE is called a fog value. As the fog value decreases, less fog is produced and image quality is excellent.

The similar continuous printing test was performed under a H/H (high temperature and humidity) environment having a temperature of 28° C. and a humidity of 80%.

(6) Odor Evaluation

An odor evaluation of toner was performed in the following manner. 10 monitors were randomly selected. The monitors were allowed to judge an odor of a source of vacuum of the printer after printing 1,000 prints in the above continuous printing test (N/N environment). Evaluation was presented by the following criteria:

A: 9 or more out of 10 monitors found the odor not uncomfortable;

B: from 6 to 8 out of 10 monitors found the odor not uncomfortable; and

C: 5 or more out of 10 monitors found the odor uncomfortable.

Example 1

75 parts of styrene and 25 parts of n-butyl acrylate as monovinyl monomers (calculated Tg of copolymer to be obtained=44° C.), 5 parts of a copper phthalocyanine pigment (C. I. Pigment Blue 15:3) as a cyan colorant, 1 part of quaternary ammonium base containing copolymer (a styrene/acrylic resin having 2 wt % of a quaternary ammonium base containing (meth)acrylate monomer unit; product name: FCA-592P; manufactured by: Fujikura Kasei Co., Ltd.; Tg: 82° C.; Mw: 12,000) as a charge control resin and 0.25 parts of polymethacrylic acid ester macromonomer (product name: AA6; manufactured by Toagosei Co., Ltd.; Tg=94° C.) were agitated by means of an agitator to mix followed by uniform dispersion by a media type dispersing machine. Thereto, 5 parts of dipentaerythritol hexamyristate (solubility against styrene: 10 g/100 g or more; endothermic peak temperature: 65° C.; molecular weight: 1,514) as a release agent was added, mixed and solved, thus obtained a polymerizable monomer composition.

Separately, an aqueous solution of 4.8 parts of sodium hydroxide (alkali hydroxide metal) dissolved in 50 parts of ion-exchanged water was gradually added to an aqueous solution of 8.6 parts of magnesium chloride (water-soluble polyvalent metallic salt) dissolved in 250 parts of ion-exchanged water while agitating to prepare a magnesium hydroxide colloid (hardly water-soluble metal hydroxide colloid) dispersion liquid. A particle size distribution of the magnesium hydroxide colloid obtained was measured by means of a particle diameter measuring device (product name: SALD; manufactured by Shimadzu Corporation). The particle diameter of D50 (50% cumulative value of number particle size distribution) was 0.36 μm and the particle diameter of D90 (90% cumulative value of number particle size distribution) was 0.80 μm.

The polymerizable monomer composition was charged into the magnesium hydroxide colloid dispersion liquid thus obtained and agitated at room temperature until droplets are stable. Then, 5 parts of t-butylperoxy-2-ethylbutanoate represented by the following Formula 9 (product name: TRIGONOX 27; manufactured by: Akzo Nobel N.V.; purity: 98%; molecular weight: 188; one-hour half-life temperature: 94° C.) as a polymerization initiator, 1.2 parts of t-dodecyl mercaptan as a molecular weight modifier and 0.5 part of divinyl benzene as a cross-linking polymerizable monomer were added therein. The mixture was subject to a high shear agitation at 15,000 rpm for 10 minutes by means of an in-line type emulsifying and dispersing machine (product name: EBARA MILDER; manufactured by Ebara Corporation) to form droplets of the polymerizable monomer composition.

Formula 9:

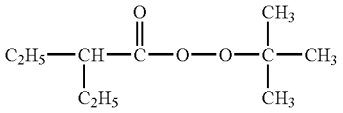

A thus obtained suspension having droplets of the polymerization monomer composition dispersed (a polymerizable monomer composition dispersion liquid) was charged into a reactor furnished with a stirring vane and a temperature thereof was raised to 90° C. to start a polymerization reaction. When a polymerization conversion rate reached 95%, 1 part of methyl methacrylate as a polymerizable monomer for shell and 0.1 part of 2,2'-azobis-[2-methyl-N-(1,1-bis(hydroxymethyl)-2-hydroxyethyl)propionamide] (product name: VA-086; manufactured by: Wako Pure Chemical Industries, Ltd.) dissolved in 10 parts of ion-exchanged water as a polymerization initiator for shell were added to the suspension. After continuing the reaction for three hours at 90° C., the reaction was stopped to obtain an aqueous dispersion of colored resin particles having a core-shell structure having pH of 9.5.

The aqueous dispersion of colored resin particles thus obtained was subject to the following stripping treatment by means of a stripping treatment system shown in FIG. 1 and by a method of blowing gas as a stripping process.

Firstly, the aqueous dispersion 4 of colored resin particles was diluted with ion-exchanged water to have a solid density of 20% and supplied to an evaporator 1. Next, 0.1 part of a defoaming agent (product name: SN DEFOAMER 180; manufactured by: San Nopco Limited) was added to the evaporator 1. A nitrogen gas was run into the evaporator 1, and a gas phase part in the evaporator was substituted with the nitrogen gas.

After the aqueous dispersion of colored resin particles was heated to 80° C. while agitating by means of agitator 3 with the stirring vane 3, a blower 6 was activated to control a flow rate of the nitrogen gas to 0.6 $m^3$/(hr·kg). The nitrogen gas was blown in the aqueous dispersion of colored resin particles through a gas blowing tube 5, a gas outlet of which has a straight tube shape, to remove volatiles from the colored resin particle.

The nitrogen gas after stripping was directed to a condenser 8 and a condensation tank 9 in this order through a gas circulation line 7. The nitrogen gas after condensation was directed to a removal device for volatiles 11 (an absorption tower filled with activated carbon) through a gas circulation line 10 to remove volatiles contained in the nitrogen gas. The nitrogen gas, which no longer contains volatiles, was blown to the evaporator 1 again through a gas circulation line 12, the blower 6 and then a gas circulation line 13.

The stripping treatment was performed for six hours at a temperature of the aqueous dispersion of colored resin particles of 80° C., a pressure in the evaporator 1 of 101 kPa and a flow rate of the nitrogen gas of 0.6 $m^3$/(hr·kg). After the treatment for six hours, the aqueous dispersion of colored resin particles was cooled down to room temperature.

Thereafter, the aqueous dispersion of colored resin particles was subject to acid washing in which sulfuric acid was added to be pH of 6.5 or less while agitating at room temperature. After separating water by filtration, the aqueous dispersion of colored resin particles was subject to water washing in which another 500 parts of ion-exchanged water was added to make a slurry again. After repeating a series of dewatering and water washing several times, the colored resin particles were separated by filtration and charged into a container of a vacuum dryer for vacuum drying at 30 torr pressure and 50° C. for one day.

The volume average particle diameter "Dv" of the colored resin particles obtained was 9.5 μm, and the size distribution "Dv/Dp" was 1.16. A thickness of shell calculated from the amount of polymerizable monomer for shell and a particle diameter of core particle (colored resin particle before forming the shell) was 0.03 μm and sphericity "Sc/Sr" was 1.2.

To the colored resin particles thus obtained of 100 parts, silica particles subjected to a hydrophobicity-imparting treatment (product name: TG820F; manufactured by: Cabot Corporation) of 0.8 part and silica particles subjected to a hydrophobicity-imparting treatment (product name: NA50Y; manufactured by: Nippon Aerosil Co., Ltd.) of 1.0 part were added and mixed by means of a high speed agitator (product name: HENSCHEL MIXER; manufactured by Mitsui Mining Co., Ltd.) to produce a non-magnetic one-component toner of Example 1 for testing.

Example 2

A toner of Example 2 was produced similarly as Example 1 except that the polymerization initiator was changed to t-butylperoxy-2-ethylhexanoate represented by the following Formula 10 (product name: PERBUTYL O; manufactured by NOF Corporation; molecular weight: 216; purity: 97%; one-hour half-life temperature: 92° C.), the stripping time was changed to 85° C. and the stripping time was changed to 10 hours:

Formula 10:

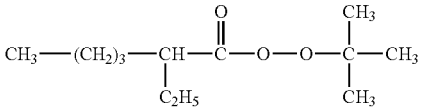

Similar tests as Example 1 were conducted with the toner of Example 2.

Comparative Example 1

A toner of Comparative example 1 was produced similarly as Example 1 except that the charge control resin was changed to a quaternary ammonium base containing copolymer (styrene/acrylic resin; product name: FCA-207P; manufactured by Fujikura Kasei Co., Ltd.; Tg: 64° C.). Similar tests as Example 1 were conducted with the toner of Comparative example 1.

Comparative Example 2

A toner of Comparative example 2 was produced similarly as Example 2 except that the charge control resin was changed to a quaternary ammonium base containing copolymer (styrene/acrylic resin; product name: FCA-207P; manufactured by Fujikura Kasei Co., Ltd.; Tg: 64° C.). Similar tests as Example 2 were conducted with the toner of Comparative example 2.

Comparative Example 3

A toner of Comparative example 3 was produced similarly as Example 1 except that the polymerization initiator was changed to t-butylperoxy-2-ethylhexanoate represented by the above-mentioned Formula 10 (product name: PERBUTYL O; manufactured by NOF Corporation; molecular weight: 216; purity: 97%; one-hour half-life temperature: 92° C.) and the amount of the polymerization initiator was changed to 6 parts. Similar tests as Example 1 were conducted with the toner of Comparative example 3.

<Results>

The test results of Examples and Comparative examples are shown in Table 1.

TABLE 1

| | | Example 1 | Example 2 | Comparative example 1 | Comparative example 2 | Comparative example 3 |
|---|---|---|---|---|---|---|
| Charge control resin | Resin | Quaternary ammonium base containing copolymer | Quaternary ammonium base containing copolymner | Quaternary ammonium base containing copolymer | Quaternary ammonium base containing copolymer | Quaternary ammonium base containing copolymer |
| | Product name | FCA-592P | FCA-592P | FCA-207P | FCA-207P | FCA-592P |
| | Tg (° C.) | 82 | 82 | 64 | 64 | 82 |
| | Added amount (part by wt) | 1 | Same as Example 1 | Same as Example 1 | Same as Example 2 | Same as Example 1 |
| Polymerization initiator | Chemical name | t-butylperoxy-2-ethylbutanoate | t-butylperoxy-2-ethylhexanoate | t-butylperoxy-2-ethylbutanoate | t-butylperoxy-2-ethylhexanoate | t-butylperoxy-2-ethylhexanoate |
| | Product name | TRIGONOX 27 | PERBUTYL 0 | TRIGONOX 27 | PERBUTYL 0 | PERBUTYL 0 |
| | Added amount (part by wt) | 5 | Same as Example 1 | Same as Example 1 | Same as Example 2 | 6 |
| Molecular weight modifier | Chemical name | t-dodecyl mercaptan | Same as Example 1 | Same as Example 1 | Same as Example 2 | Same as Example 1 |
| | Added amount (part by wt) | 1.2 | Same as Example 1 | Same as Example 1 | Same as Example 2 | Same as Example 1 |
| Stripping treatment | Temperature (° C.) | 80 | 85 | 80 | 85 | 80 |
| | Time (hr) | 6 | 10 | 6 | 10 | 6 |
| Residual component in toner | Residual amount of ether component (ppm) | 22 | 320 | 25 | 350 | 3300 |
| | Residual amount of styrene (ppm) | 15 | 12 | 20 | 34 | 42 |
| Printing performance of toner | Shelf stability rate (%) at high temperature (%) | 0.5 | 0.6 | 1.1 | 1.1 | 21.5 |
| | Continuous printing in NN environment (prints) | 16,000 | 15,000 | 13,000 | 12,000 | 9,000 |
| | Continuous printing in HH environment (prints) | 15,000 | 14,000 | 12,000 | 10,000 | 7,000 |
| Odor evaluation of toner | | A | B | A | B | C |

The following can be found from the test results shown in Table 1. The toners of Comparative example 1 and Comparative example 2 were inferior in shelf stability at high temperature, could not stably hold the charge amount of toner and were inferior in printing durability under N/N and H/H environments since Comparative example 1 and Comparative example 2 did not use the quaternary ammonium base containing copolymer specified of present invention as the charge control resin.

Also, Comparative example 3 used the quaternary ammonium base containing copolymer specified of present invention as the charge control resin of the toner. However, since the residual amount of the ether component exceeded the range specified in the present invention, the toner of Comparative example 3 was inferior in shelf stability at high temperature and inferior in printing durability under the N/N and H/H environments.

To the contrary, Example 1 and Example 2 used the quaternary ammonium base containing copolymer (FCA-592P) specified of the present invention as the charge control resin of the toner. Hence, the toners of Example 1 and Example 2 were small in residual amount of ether component and styrene remaining in toner, were small in odor generation, were excellent in shelf stability at high temperature, could stably hold charge amount of toner and were excellent in printing durability under the N/N and H/H environments.

What is claimed is:

1. A toner for developing electrostatic image comprising a colored resin particle which is obtained by polymerizing a polymerizable monomer composition containing a polymerizable monomer, a colorant and a charge control resin in an aqueous dispersion medium in the presence of a polymerization initiator, wherein the charge control resin is a quaternary ammonium base containing copolymer having a glass transition temperature "Tg" in the range from 75 to 95° C.;

the polymerization initiator is an organic peroxide; and each residual amount of an ether component and styrene remaining in the toner for developing electrostatic image is respectively less than 500 ppm and less than 50 ppm.

2. The toner for developing electrostatic image according to claim 1, wherein the organic peroxide is a peroxy ester compound represented by the following Formula 1:

Formula 1:

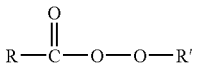

wherein, each of R and R' is an alkyl group.

3. The toner for developing electrostatic image according to claim 2, wherein each of R and R' in the Formula 1 is an alkyl group having 6 or less carbons.

4. The toner for developing electrostatic image according to claim 3, wherein the peroxy ester compound represented by Formula 1 in which carbon number of R and R' is 6 or less is t-butylperoxy-2-ethylbutanoate represented by the following Formula 9, t-butylperoxy-pivalate represented by the following Formula 13 or t-hexylperoxy-pivalate represented by the following Formula 14:

Formula 9:

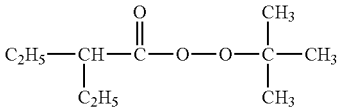

Formula 13:

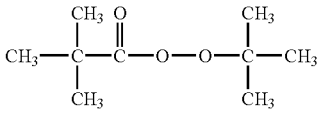

Formula 14:

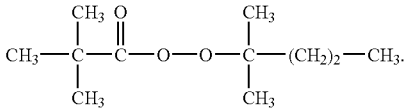

5. The toner for developing electrostatic image according to claim 1, wherein a molecular weight of the organic peroxide is 205 or less.

6. The toner for developing electrostatic image according to claim 1, wherein an added amount of the organic peroxide is in the range from 0.1 to 15 parts by weight with respect to 100 parts by weight of the monovinyl monomer.

7. The toner for developing electrostatic image according to claim 1, wherein the quaternary ammonium base containing copolymer is a copolymer comprising a repeating structural unit having quaternary ammonium base represented by the following Formula 2:

Formula 2:

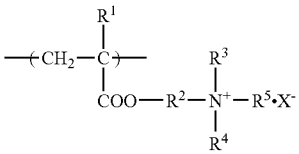

wherein, $R^1$ is a hydrogen atom or a methyl group; $R^2$ is an alkylene group having 1 to 3 carbons; each of $R^3$ to $R^5$ is independently an alkyl group having 1 to 6 carbons, a phenyl group or an aralkyl group having 1 to 12 carbons; X is a halogen atom, an alkyl sulfonate residue having 1 to 6 carbons, a benzenesulfonate residue or a paratoluene sulfonate residue.

8. The toner for developing electrostatic image according to claim 7, wherein a vinyl monomer unit and a (meth)acrylate monomer unit is contained as the repeating structural unit constituting the quaternary ammonium base containing copolymer besides the repeating structural unit having quaternary ammonium base represented by the Formula 2.

9. The toner for developing electrostatic image according to claim 1, wherein a containing amount of a repeating structural unit having quaternary ammonium base in the quaternary ammonium base containing copolymer is in the range from 0.05 to 12 wt %.

10. The toner for developing electrostatic image according to claim 1, wherein a copolymerization ratio (weight ratio) of a vinyl aromatic hydrocarbon monomer unit and a (meth) acrylate monomer unit contained as repeating structural units constituting the quaternary ammonium base containing copolymer is in the range from 70:30 to 90:10.

11. The toner for developing electrostatic image according to claim 1, wherein a weight average molecular weight "Mw" of the quaternary ammonium base containing copolymer is in the range from 2,000 to 50,000.

12. The toner for developing electrostatic image according to claim 1, wherein an added amount of the quaternary ammonium base containing copolymer is in the range from 0.01 to 20 parts by weight with respect to 100 parts by weight of a binder resin.

13. The toner for developing electrostatic image according to claim 1, wherein the toner is a core-shell type toner.

14. A method of producing a toner for developing electrostatic image comprising the steps of:

(1) a preparation process of a polymerizable monomer composition, in which a polymerizable monomer, a colorant, a quaternary ammonium base containing copolymer having a glass transition temperature "Tg" in the range from 70 to 100° C. as a charge control resin are mixed together to prepare a polymerizable monomer composition;

(2) a suspension process, in which after the polymerizable monomer composition is dispersed in an aqueous dispersion medium comprising a dispersion stabilizer, an organic peroxide as a polymerization initiator is added and droplets of the polymerizable monomer composition are formed so as to obtain a suspension;

(3) a polymerization process, in which a temperature of the suspension is raised for polymerization so as to obtain an aqueous dispersion liquid of a colored resin particle; and (4) a stripping process, in which the aqueous dispersion liquid of the colored resin particle is subject to a stripping treatment, wherein each residual amount of an ether component and styrene remaining in the toner for developing electrostatic image is respctively less than 500 ppm and less than 50 ppm.

15. The method of producing a toner for developing electrostatic image according to claim 14, wherein the organic peroxide is a peroxy ester compound represented by the following Formula 1:

Formula 1:

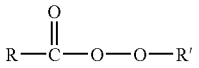

wherein, each of R and R' is an alkyl group.

16. The method of producing a toner for developing electrostatic image according to claim 15, wherein each of R and R' in the Formula 1 is an alkyl group having 6 or less carbons.

17. The method of producing a toner for developing electrostatic image according to claim 14, wherein a temperature of the stripping treatment in the (4) stripping process is a glass transition temperature (Tg) of a binder resin comprising the colored resin particles or more and less than (Tg+75)° C.

18. The method of producing a toner for developing electrostatic image according to claim 14, wherein time required for the stripping treatment is in the range from 0.5 to 40 hours.

19. The method of producing a toner for developing electrostatic image according to claim 14, wherein a polymerizable monomer for forming a shell layer and a polymerization initiator for shell are added to the aqueous dispersion medium to which the colored resin particles to be a core particle are dispersed followed by polymerization.

* * * * *